United States Patent [19]

Lawson

[11] 4,340,117

[45] Jul. 20, 1982

[54] UNDERWATER WELL INSTALLATIONS AND HANDLING STRING JOINT THEREFOR

[75] Inventor: John E. Lawson, London, England

[73] Assignee: Armco Inc., Middletown, Ohio

[21] Appl. No.: 120,044

[22] Filed: Feb. 11, 1980

[51] Int. Cl.[3] ..... E21B 7/12

[52] U.S. Cl. ..... 166/341; 166/359; 166/360; 166/382; 285/29; 285/137 A

[58] Field of Search ..... 285/137 A, 319, 18, 285/27, 29; 166/75 A, 315, 313, 341, 338, 339, 340, 360, 358, 359

[56] References Cited

U.S. PATENT DOCUMENTS

| | | | |
|---|---|---|---|
| 2,976,933 | 3/1961 | Henslee, Jr. | 285/27 X |
| 3,604,731 | 9/1971 | Peterson | 285/137 |
| 3,653,435 | 4/1972 | Reistle | 166/313 |
| 4,067,385 | 1/1978 | Schwager et al. | 285/137 A |
| 4,114,928 | 9/1978 | Lochre | 285/18 |

*Primary Examiner*—William F. Pate, III

*Attorney, Agent, or Firm*—Roylance, Abrams, Berdo & Farley

[57] ABSTRACT

Underwater well apparatus in which the handling string for manipulating a handling tool to, e.g., orient and land a multiple string tubing hanger includes a power portion in the form of a single metal piece having a plain cylindrical outer surface to be presented to the blowout protectors, so that orientation of the handling string relative to the protectors is not necessary, and also having through passages for communicating with the tubing strings, and coupling means for attaching the handling tool to the handling string.

3 Claims, 7 Drawing Figures

UNDERWATER WELL INSTALLATIONS AND HANDLING STRING JOINT THEREFOR

This invention relates to underwater well installations of the type described in copending application Ser. No. 36,658, filed May 7, 1979, by Kerry G. Kirkland and to improved handling string joints therefor.

RELATED APPLICATIONS

Subject matter disclosed herein is also disclosed and claimed in my copending applications Ser. Nos. 120,047, 120,851, 120,046, 120,045, 120,695 and 120,052, filed concurrently herewith.

BACKGROUND OF THE INVENTION

One of the tasks involved in establishing an underwater well is the installation, operation and retrieval of well tools such as tubing hangers, casing hangers, pack-off or seal devices, and the like. Other typical tasks include carrying out work-over operations, to service the well. Much work in these areas has been done and it has become common practice to install underwater well components or tools with a handling string, usually in the form of a string of drill pipe, as shown for example in U.S. Pat. No. 4,003,434, issued Jan. 18, 1977, to Garrett et al. Such methods and apparatus have also been applied to multiple string well installations, as seen for example in U.S. Pat. Nos. 3,661,206, issued May 9, 1972, to Putch et al, and U.S. Pat. No. 3,741,294, issued June 26, 1973, to Morrill. While such prior-art efforts have achieved considerable success in the field, there has been a continuing need both for overall improvement and for methods and apparatus which will solve a number of common problems as yet not satisfactorily met. One such problem arises first from the need to maintain communication with well pipes, typically multiple tubing strings, during such operations as landing of a tubing hanger, while providing adequately for blowout protection. That problem becomes more complicated as the water depth increases since, to provide adequate blowout protection conventionally, it is necessary that the tubing strings be positively positioned relative to the blowout preventer, and precise positioning is difficult if not impossible to achieve from the surface by prior-art practices when the strings of pipe extending from the surface to the wellhead are very long. To solve this problem, Kirkland in aforementioned application Ser. No. 36,658 provides a handling string which, while affording communication between the operational base at the surface of the body of water and the well via multiple tubing strings and smaller hydraulic conduits, presents to the blowout preventer a single cylindrical outer surface so that rotational orientation of the handling string relative to the blowout preventer is unnecessary. Though the Kirkland apparatus has proved successful, it has required that at least the lowermost joint of the handling string be built up from a large number of parts, including an outer tubular shell, a plurality of internal pipes and tubes, spacers and partitions, and valve means for filling and emptying the space within the shell. There has accordingly been a need for improvement of apparatus of this type.

OBJECTS OF THE INVENTION

A general object of the invention is to devise apparatus of the type described in which the lowermost joint of the handling string is a single solid metal body.

Another object is to provide such apparatus having improved coupling means which, though adequately compact to be accommodated in the small annular space available, is of improved load-carrying capability.

SUMMARY OF THE INVENTION

Underwater well installations according to the invention comprise underwater wellhead means including a wellhead upper body having an upright bore and blowout protector means mounted on the upper body; handling string means capable of extending from a vessel or other operational base at the surface of the body of water to the wellhead means and comprising a lowermost joint in the form of a single solid metal body which has a cylindrical outer surface of a length adequate to extend through the blowout protector means, so that the blowout protector means can close on and seal against the cylindrical surface, the body being provided with at least one larger diameter through the bore to communicate with a tubing string and a plurality of smaller through bores to communicate with hydraulic flow conduits; a handling tool having body means equipped with flow passages opening upwardly at the upper end of the handling tool for communicating with the respective through bores in the solid body of the lowermost handling string joint, the handling tool having downwardly directed means for operative engagement with a well component such as a tubing hanger; and load-bearing coupling means interconnecting the upper end of the handling tool and the lower end of the lowermost handling string joint.

IDENTIFICATION OF THE DRAWINGS

In order that the manner in which the foregoing and other objects are achieved according to the invention can be understood in detail, one particularly advantageous embodiment thereof will be described with reference to the accompanying drawings, which form a part of the original disclosure of this application, and wherein.

DETAILED DESCRIPTION OF THE APPARATUS

Figure 1:
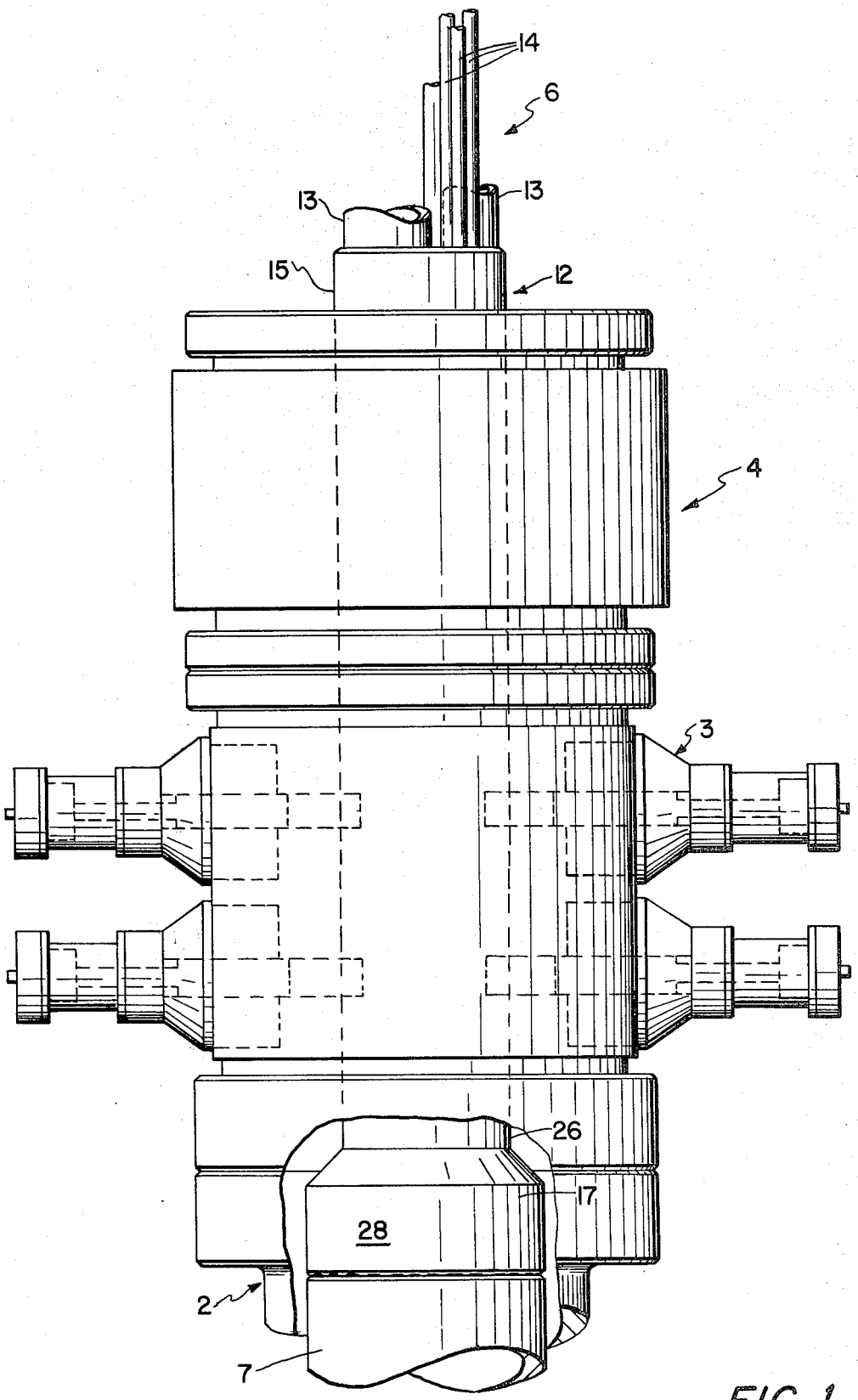
FIG. 1 is a side elevational view of a portion of a wellhead installation embodying the invention.
Figure 2:
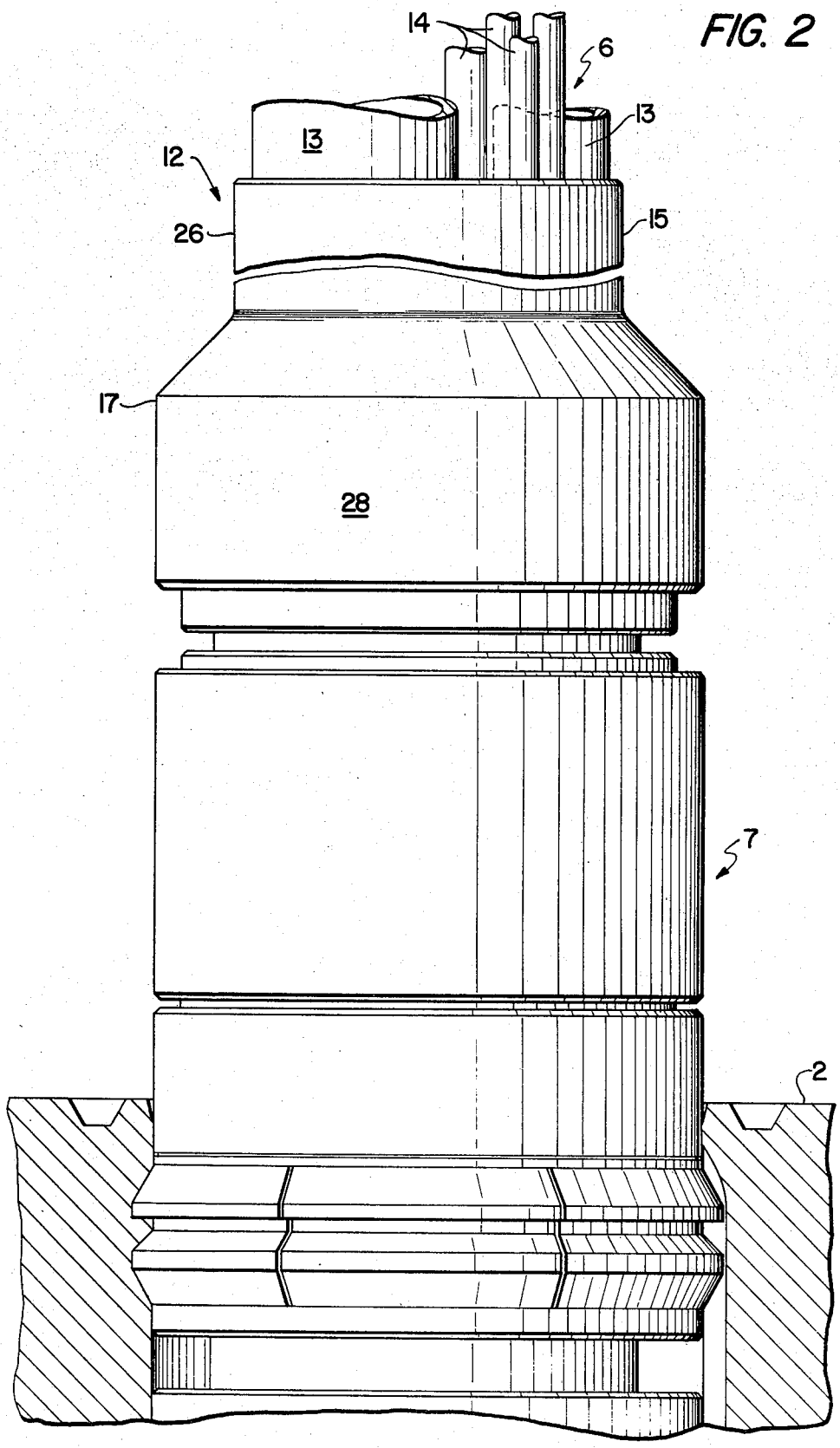
FIGS. 2–2B are side elevational views, with some parts shown in vertical cross section, which combine to illustrate the combination of the lower end of the handling string, a handling tool attached thereto, and a tubing hanger attached to the handling tool, in the assembly shown in FIG. 1.
Figure 2A:
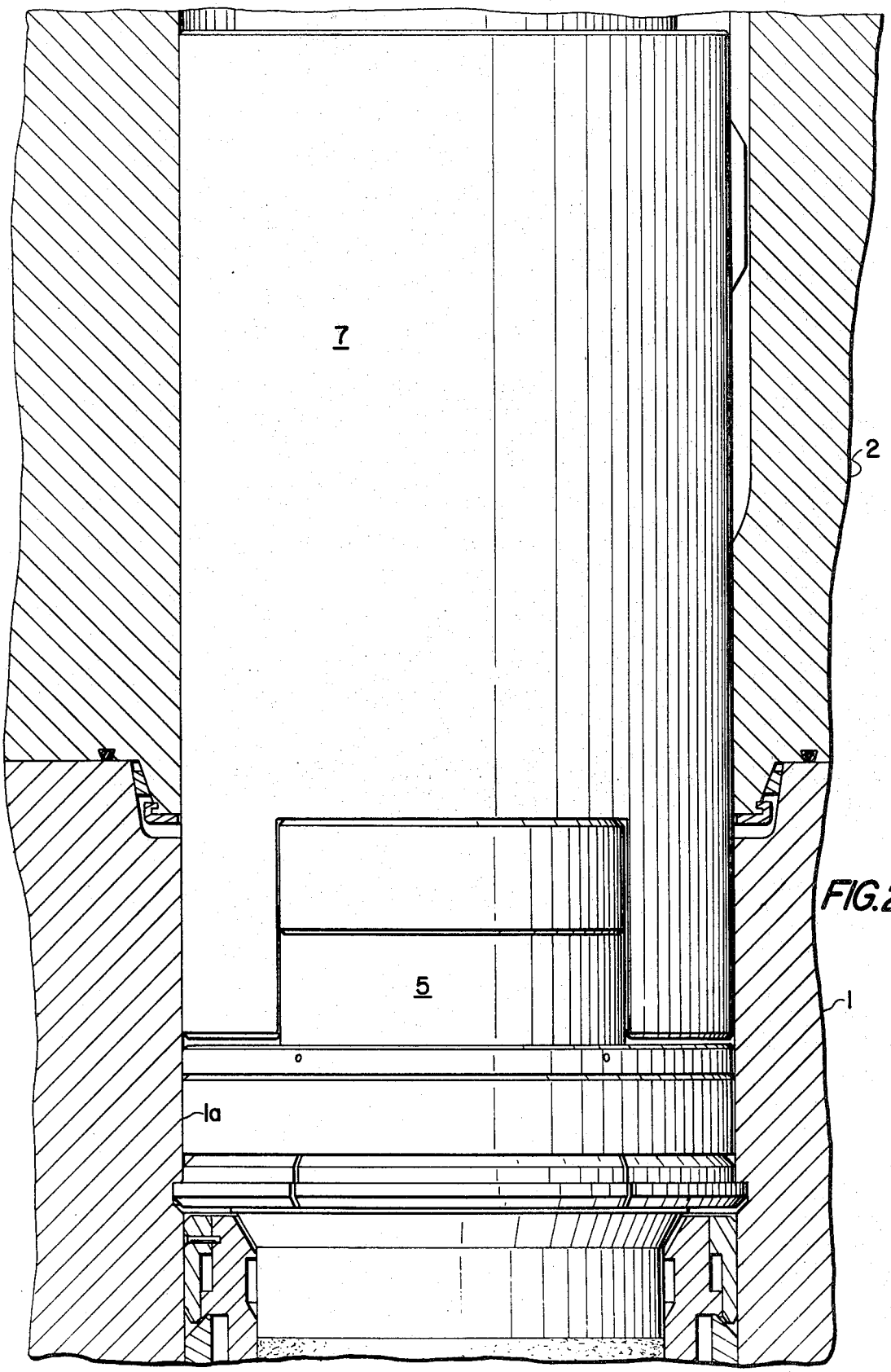
Figure 2B:
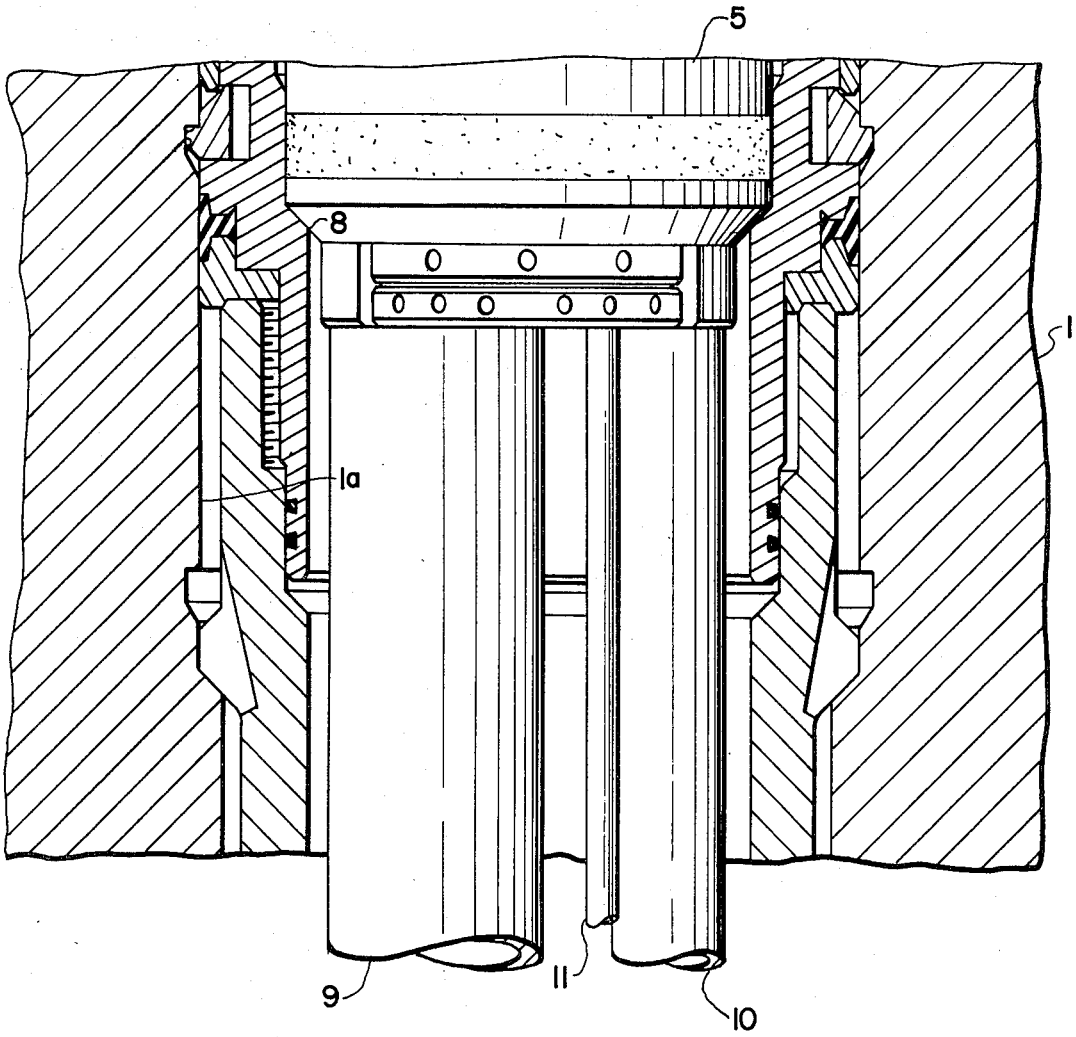

The invention is illustrated as applied to an underwater well installation comprising a wellhead lower body 1, FIGS. 2A and 2B, a drilling upper body 2, FIGS. 1 and 2, and conventional blowout protector means comprising ram-type protector 3 and bag-type protector 4, these elements having been installed conventionally at or near the bottom of the body of water by remote operations carried out from a vessel or other operational base at the surface of the body of water with the aid of a guidance system such as that described in U.S. Pat. No. 2,808,229, issued Oct. 1, 1957, to Bauer et al. The installation is shown as it exists after a multiple string tubing hanger 5, having been rotationally oriented relative to body 2 by manipulating handling string means 6 and handling tool 7, has been landed on a support shoulder 8 in the upright bore 1*a* of lower body 1. Tubing hanger 5 is described in detail in my aforementioned copending applications Ser. Nos. 120,695 and 120,052 and handling tool 7 is described in detail in my aforementioned copending applications Ser. Nos. 120,047, 120,851, 120,046 and 120,045. Tubing strings 9, 10 and downhole safety valve conduits, as at 11, FIG. 2B, depend from the tubing hanger and apply to the hanger, and thus to the handling tool and handling string during final running in of the tubing, a load which may be as great as 300,000 pounds or more.

Handling string means 6 comprises a lowermost joint 12 of a length such that the joint can extend completely through the blowout protectors, the balance of the handling string being made up of interconnected joints of drill pipe or the like 13, FIG. 1, secured to lowermost joint 12, and a plurality of smaller conduits 14 arranged in a bundle extending beside the larger weight-supporting pipe 13. Joint 12 is formed as a single integral metal body 15, FIG. 3, having a flat transverse upper end face 16 and, at its lower end, an enlarged connector portion 17. Body 15 has two larger diameter through bores 18 and 19 to communicate between the respective strings of larger diameter handling string pipe 13 and stingers 20 and 21, respectively, which extend downwardly through handling tool 7 to communicate with passages (not shown) in tubing hanger 5 and thus with tubing strings 9 and 10, respectively. Similar but smaller diameter through bores (not shown) are provided to communicate between the smaller diameter conduits 14 of the handling string and stingers 22 and 23, FIG. 4, and thence through the handling tool and tubing hanger with the smaller diameter conduits 11 suspended from the tubing hanger. Additional small diameter through bores (not shown) are provided in body 15 to communicate with the pressure fluid conduits of the handling tool, as described in my copending application Ser. No. 120,851. The upper end portion of each through passage of body 15 is threaded, as shown at 24 and 25, FIG. 3, for passages 18 and 19, respectively, so that secure load-bearing connections between the pipes of the handling string and body 15 can be made up as shown.

Body 15 has an elongated right cylindrical outer surface portion 26 which is continuous from lower end portion 17 to upper end face 16, surface 26 being concentric with the longitudinal axis of the body. Lower end portion 17 includes a dependent annular wall 27 defined by a right cylindrical outer surface 28 and a right cylindrical inner surface 29, surfaces 28 and 29 both being coaxial with and of larger diameter than surface 26. At its lower end, wall 28 is of decreased outer diameter for a short axial distance, presenting cylindrical outer surface portion 30 and downwardly facing transverse annular shoulder 31. At its upper end, inner surface 29 joins a flat circular end face 32 in two diametrically opposed areas. Each through passage of body 15 is enlarged at its lower end to provide cylindrical receptacles which open downwardly through end face 32 to accommodate the upper end portions of the respective stingers which project upwardly from the upper end of the handling tool. Thus, passage 18 is enlarged to provide receptacle 33 to accommodate the upper end portion of stinger 20, and passage 19 is similarly enlarged to provide receptacle 34 for stinger 21.

Dependent wall 27 is provided with a transverse annular locking groove 35 defined by frustoconical upper and lower side walls 36 and 37, respectively, and a right cylindrical outer wall 38. Side walls 36 and 37 are mutually parallel and taper downwardly and inwardly so that groove 35 opens downwardly and inwardly into the space within dependent wall 27. Handling tool 7 presents an upper end face 39 so that, when dependent wall 27 is telescoped over the upper end of the handling tool, faces 32 and 39 come into engagement and groove 35 therefore occupies a predetermined axial position relative to the handling tool. The body of handling tool 7 is provided with a transverse annular outwardly opening groove defined in part by a frustoconical upper side wall or shoulder 40 and a right cylindrical inner wall 41, upper side wall 40 tapering downwardly and inwardly at the same angle as do side walls 36, 37 of groove 35. When faces 32 and 39 are engaged, groove 35 opens into the space below shoulder 40, as shown in FIG. 3, with shoulder 40 being spaced slightly below upper side wall 36.

Figure 5:
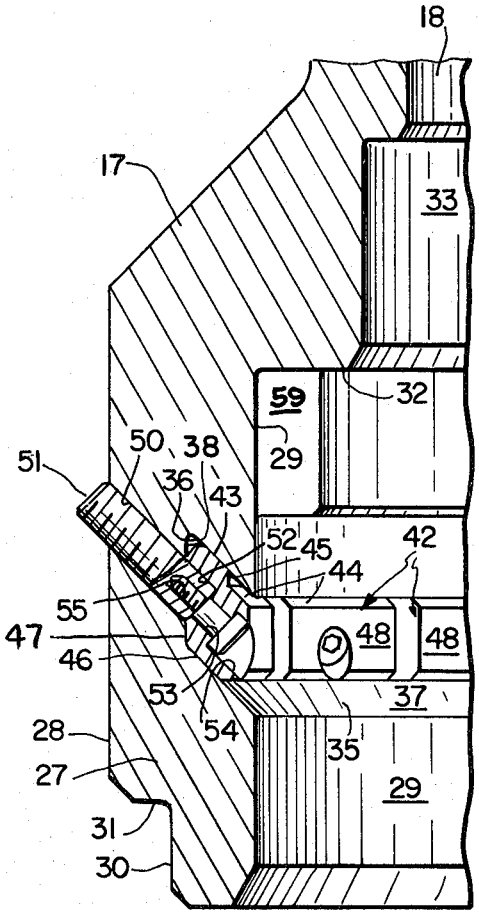
FIG. 5 is a fragmentary vertical sectional view of a portion of the structure seen in FIG. 3 showing a locking segment in retracted position.

Groove 35 slidably accommodates a plurality of locking segments 42 arranged in an arcuate series. As best seen in FIG. 5, each segment has an upper face comprising a frustoconical outer surface portion 43, a frustoconical inner surface portion 44, and an axially short right cylindrical portion 45 joining portions 43, 44. Portions 43, 44 are mutually parallel, portion 44 being spaced below portion 43 by a distance determined by the axial length of portion 45 and thus by that distance necessary for portion 44 to be disposed for sliding engagement with shoulder 40 when faces 32, 39 are engaged. Lower face 46 of each segment is continuous, uninterrupted and parallel to surface portions 43 and 44. Lower face 46 is spaced axially from surface portion 43 by a distance only slightly less than the space between side walls 36, 37 of groove 35 so that, when the segments are disposed in groove 35, surface portion 43 slidably engages side wall 36 and face 46 slidably engages side wall 37. Outer face 47 of each segment is right cylindrical, therefore parallel to wall 38. Inner face 48 of each segment is also right cylindrical and therefore parallel to wall 41.

Dependent annular wall 27 is provided with a plurality of identical through bores 50 which are radially disposed in plan elevation and slant downwardly and inwardly at the same angle as do side walls 36, 37 of groove 35. Bores 50 are threaded to coact with socket head adjusting screws 51. At its midpoint, each segment is provided with a through bore which slants downwardly and inwardly so as to extend parallel to side walls 36, 37 of groove 35. Each such through bore includes a larger end portion 52 opening outwardly and upwardly through outer face 47, a smaller diameter intermediate portion 53, and a larger diameter end portion 54 which opens inwardly through inner face 48. For each segment 42, the tip of one of the adjusting screws 51 is engaged in outwardly opening end portion 52 of the through bore of the segment, and the adjusting screw is secured to the segment, while being free to rotate relative thereto, by a securing screw 55 which has its threaded end engaged in a threaded bore in the inner end of screw 51 and its head disposed in inner end portions 54 and engaged with the shoulder which joins through bore portions 53 and 54.

Figure 3:
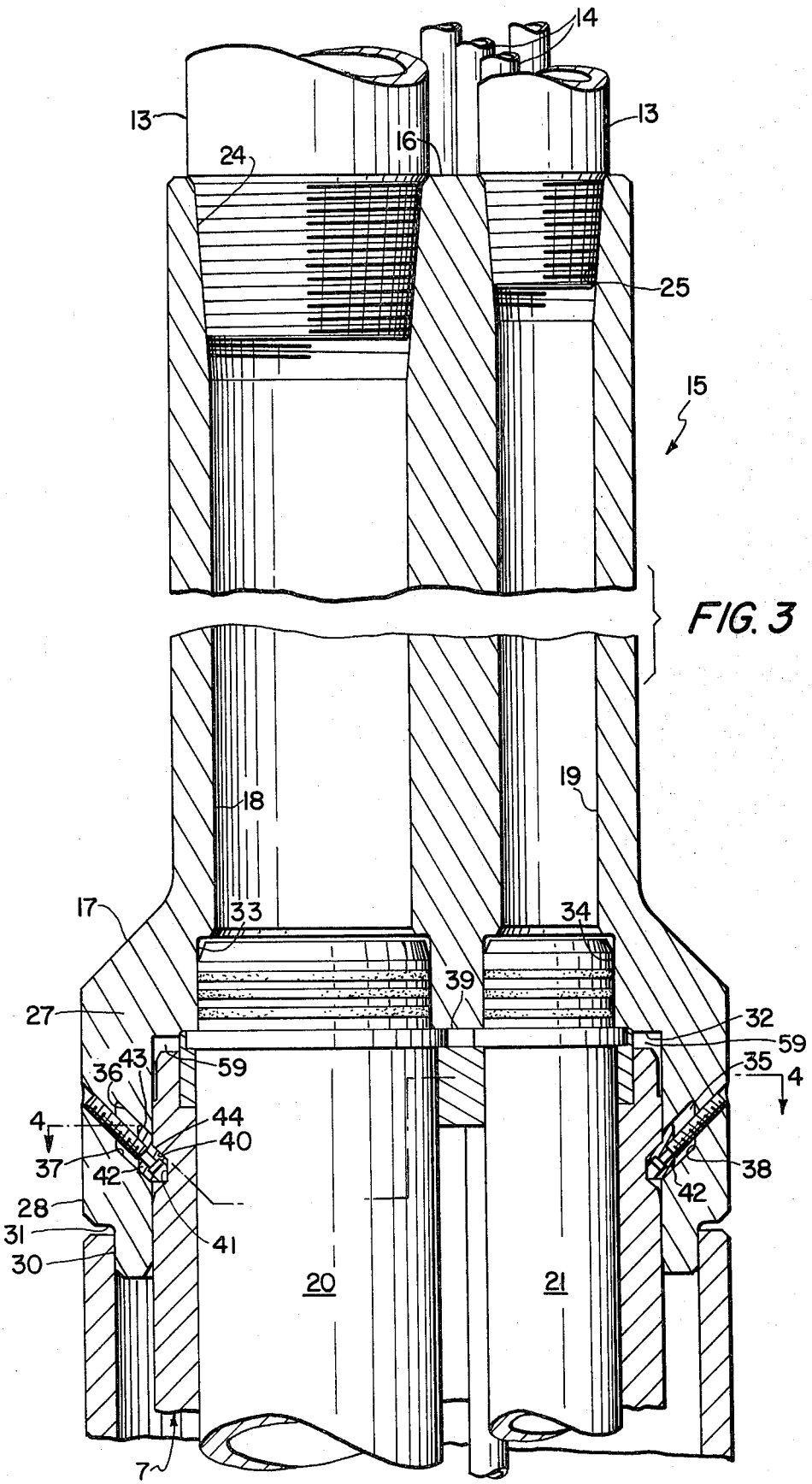
FIG. 3 is a vertical cross-sectionaal view of the lowermost joint of a handling string according to the invention, with the upper end of the handling tool attached thereto.

It will be apparent that, by rotating screws 51 in the proper direction, segments 42 can be driven downwardly and inwardly through groove 35 until, as seen in FIG. 3, upper face portions 44 are engaged with shoulder 40 and inner face portions 48 are engaged with walls 41 of the handling tool. The coupling means comprising dependent wall 27, groove 35, segments 42 and screws 51 on body 15, and shoulder 40 and wall 41 on the handling tool thus securely connects the handling tool to body 15 of the handling string means. Further, though occupying only a relatively small annular space, which is limited by the necessary size of passages 18, 19 on the one hand and the requirement that enlarged portions 17 must pass through the blowout protector means on the other hand, the coupling has the capability of supporting very large loads. In this connection, with the angles of taper of walls 36 and 37, face portions 43, 44 and face 46, and shoulder 40 being 45°, and with surfaces 48 and 41 in engagement, the heavy weight of the tubing strings is transferred through segments 42 almost entirely in compression, shear components being virtually eliminated.

Figure 4:
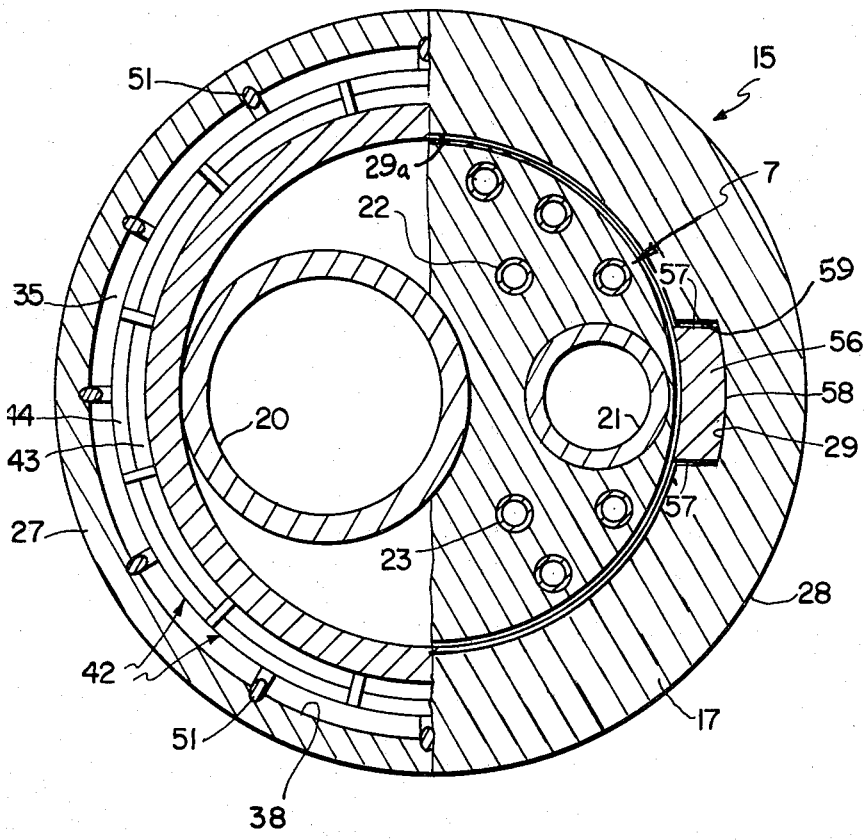
FIG. 4 is a transverse cross-sectional view taken generally on line 4—4, FIG. 3.

By comparing FIGS. 4 and 5, it will be seen that, adjacent face 32, inner surface 29 extends circumferentially for only short distances in two diametrically opposed locations to embrace the arcuate outer surfaces of two diametrically opposed upwardly projecting locator splines 56 integral with and extending upwardly from the upper end portion of the body of handling tool 7. Splines 56 are of relatively small circular extent and have flat side walls 57, FIG. 4. Portion 17 of body 15 presents arcuate inner surface portions 29*a*, FIG. 4, which are joined to the diametrically opposed upper end portions of surface 29 by flat surface portions 59, best seen in FIG. 5, to engage the respective side walls 57 of the splines. Thus, in effect, portion 17 presents a downwardly opening socket having two inwardly opening diametrically opposed upright locator slots disposed to coact with the two locator splines to so orient body 15 and the body of handling tool 7 that sockets 33, 34 are coaxial with stingers 20 and 21, respectively.

It will be apparent that, when hanger 5 has been landed on shoulder 8, FIG. 2B, so that the handling tool supported by body 15 is within the drilling upper body 2, FIG. 1, the plain cylindrical surface 26 of body 15 is presented to the blowout protectors, and since communication between the pipes and conduits of the handling string and the passages in the handling tool is via the through bores of body 15, there is no need for rotational orientation of body 15 relative to the blowout protector means.

What is claimed is:

1. In an underwater well apparatus, the combination of underwater wellhead means including a wellhead upper body having an upright bore, and blowout protector means mounted on the wellhead upper body;

handling string means capable of extending from the wellhead upper body to an operational base at the surface of the body of water and including a lowermost joint in the form of a single solid metal body having a cylindrical outer surface of a length adequate to extend completely through the blowout protector means, at least one larger diameter through bore, and a plurality of smaller diameter through bores, the upper end of the at least one larger diameter through bore being formed with means for connection to a joint of handling string pipe, the upper ends of said smaller diameter through bores each being formed with means for connection to a small diameter flow conduit, a string of pipe connected to the upper end of the lowermost joint in load-supporting relation therewith and in communication with the larger diameter through passage, and a bundle of small diameter conduits extending beside the string of pipe with each conduit connected to and communicating with a different one of the smaller diameter through bores of the lowermost joint, the transverse dimensions of the metal body of the lowermost joint being such that the body can be passed downwardly through the blowout protector means until the cylindrical outer surface of the body is presented for operative engagement by the blowout protector means;

a handling tool comprising body means having an upper end and flow passage means opening upwardly therethrough, the body means being dimensioned to pass through the blowout protector means and enter the bore of the wellhead upper body, the upper end portion of the handling tool body means having a transverse annular outwardly opening locking groove having a frustoconical upper side wall which tapers downwardly and inwardly, and a cylindrical inner wall, and downwardly directed means for operative engagement with a well component;

the lower end portion of the metal body of said lowermost joint having a downwardly opening socket dimensioned to receive the upper end portion of the handling tool, the socket being defined by an annular dependent wall having a cylindrical inner surface, the annular dependent wall being formed with an inwardly opening transverse annular locking groove having a frustoconical upper side wall which tapers downwardly and inwardly at the same angle as does the upper side wall of said outwardly opening groove of the handling tool body, a frustoconical lower side wall parallel to said upper side wall of the inwardly opening groove, and an outer wall; and load-bearing coupling means interconnecting the upper end of the handling tool and the lower end of the lowermost joint of the handling string and comprising a plurality of arcuate segments arranged in an annular series and slidably engaged between the upper and lower side walls of the inwardly opening groove in the annular dependent wall and projecting inwardly into said outwardly opening groove of the handling tool, the inner portions of said segments having upper frustoconical faces slidably engaged with the upper side wall of said outwardly opening groove, and a plurality of segment adjusting screws operatively engaged in threaded bores which extend downwardly and inwardly through said annular dependent wall.

2. The combination defined in claim 1, wherein the annular wall defining the downwardly opening socket includes a portion presenting a cylindrical inner surface located above the inwardly opening locking groove and interrupted by two diametrically opposed inwardly opening upright locator slots; and the handling tool body means includes an upper end portion having a cylindrical outer surface embraced by the cylindrical inner surface of the annular wall, and two outwardly projecting locator splines each disposed in a different one of the locator slots.

3. The combination defined in claim 1, wherein the upper faces of the segments each comprise a first frustoconical portion in slidable engagement with the upper side wall of the inwardly opening locking groove, a second frustoconical portion in slidable engagement with the upper side wall of the outwardly opening groove, the second frustoconical portion being spaced below the first frustoconical portion and located inwardly therefrom.

* * * * *